United States Patent [19]

Weber

[11] 4,181,059

[45] Jan. 1, 1980

[54] CIRCUIT FOR SIMULATING SOUND OF WIRE BRUSH ROTATED AROUND HEAD OF SNARE DRUM

[75] Inventor: Christopher M. Weber, Alsip, Ill.

[73] Assignee: CBS Inc., New York, N.Y.

[21] Appl. No.: 895,164

[22] Filed: Apr. 11, 1978

[51] Int. Cl.[2] ..... G10D 13/02; G10H 5/06

[52] U.S. Cl. ..... 84/1.24; 84/DIG. 12

[58] Field of Search ..... 84/1.01, 1.04, 1.24, 84/1.17

[56] References Cited

U.S. PATENT DOCUMENTS

| | | | |
|---|---|---|---|
| 3,247,308 | 4/1966 | Peterson | 84/1.17 |
| 3,328,506 | 6/1967 | Park | 84/1.24 |
| 3,516,319 | 6/1970 | Munch | 84/1.24 |
| 3,593,187 | 7/1971 | Dodds et al. | 84/1.24 |
| 3,595,980 | 7/1971 | Tomisawa | 84/1.24 |
| 3,636,801 | 1/1972 | Ichikawa | 84/1.24 |
| 3,655,904 | 4/1972 | Cohen | 84/1.24 |
| 3,743,757 | 7/1973 | Okamoto | 84/1.24 |

*Primary Examiner*—Gene Z. Rubinson
*Assistant Examiner*—Forester W. Isen
*Attorney, Agent, or Firm*—Spencer E. Olson

[57] ABSTRACT

An electronic musical circuit simulates the sound of a wire brush rotated around the head of a snare drum by differently amplitude modulating and bandpass filtering in separate channels a noise signal derived from a suitable source and summing the modulated and filtered noise signals from the separate channels to produce a sound imitative of the rhythmic variations in pitch and amplitude produced by wire brush rotation on the head of a snare drum.

10 Claims, 3 Drawing Figures

CIRCUIT FOR SIMULATING SOUND OF WIRE BRUSH ROTATED AROUND HEAD OF SNARE DRUM

BACKGROUND OF THE INVENTION

This invention relates to electronic musical instruments, and is more particularly concerned with an electronic circuit for use in an electronic organ for simulating the rhythmic variations in sound produced by rotation of a wire brush around the head of a snare drum.

In the evolutionary development of electronic organs, muscial devices have been developed which automatically produce repetitive rhythms for accompaniment with the organ. This, in turn, has given rise to a need for and development of a variety of electrically produced sounds, the sources of which are often spoken of as "instruments." For example, modern automatic repetitive rhythm devices may include "instruments" producing sounds that may contain a great many frequencies but that have no pitch characteristics, such as drums, cymbals, wood blocks, tom-toms, tambourines, and many others.

A sound that heretofore has not been acceptably simulated electrically is that produced when a drummer rotates a wire brush around the head of a snare drum; that is, when the free end of a brush consisting of a bundle of long flexible wires is maintained in light contact with and rotated around the stretched membrane of the drum (as opposed to beating on the membrane with sticks) to provide a subdued rhythmic accompaniment in certain types of musical selections, such as waltzes, fox trots and jazz ballads, for example. Although this sound is basically unpitched, because of the change in angle between the wire brush and the drumhead as the drummer rotates the brush, there are what may be characterized as cyclic variations in the resulting sound, one such cycle occurring during the complete revolution (360°) of the brush around the drumhead and the other cycle being completed in only one-half a revolution (180°) of the brush around the head. These cyclical variations in the timbre of an otherwise unpitched sound, characteristic of the random contact of the wires of the brush with the head of a snare drum, makes this a particularly difficult sound to produce electrically.

Although it is known from U.S. Pat. No. 3,328,586 to produce electrically a sound simulative of a snare drum, applicant is unaware of any system for simulating the sound produced when a wire brush is rotated around the head of a snare drum. The system according to this patent achieves the sound of a snare drum by combining a drum sound source with a snare drum sound source. The drum circuit employs a pair of tuned tank circuits which are responsive to a pulse source, and the snare drum sound circuit employs the same pulse source and includes wave-shaping devices which provide a voltage for keying an AC modulated "white noise" source to produce a sound simulative of a snare drum. The signals from the two sources are mixed, filtered and amplified to produce the desired sound.

Other examples of circuits utilizing random noise for producing unpitched percussive sounds are described in U.S. Pat. No. 3,247,308. In this system a signal from a random noise generator is applied to a plurality of envelope controlling devices, such as variable gain amplifiers or variable attenuators, which produce at their respective outputs a noise signal having an intensity determined by the envelope controlling devices. These amplitude modulated signals are separately filtered and then combined and applied to an output amplifier and loudspeaker. The circuit includes a plurality of pulse generators, one in each channel, each of which when energized delivers a single pulse of energy to its associated envelope controlling apparatus. These pulses, which may be of any preselected duration, control the envelope controlling apparatus in such a manner that a signal from the random noise generator is keyed with a percussive envelope characteristic; the resulting pulse of the random noise signal is filtered and when reproduced is heard as an unpitched percussive sound.

It is the object of the present invention to produce electrically a sound simulative of that produced by rotation of a wire brush around the head of a snare drum.

BRIEF DESCRIPTION OF THE INVENTION

Briefly, the object of the invention is achieved by a system including a plurality of channels each of which includes an amplitude adjusting device and a filter, a source of random noise connected to each of the channels, and a digital counter operative in response to clock pulses, whose rate is controlled by the tempo control of the rhythm pattern generator of an electronic organ, to differently control the amplitude adjusting devices of the different channels so as to differently amplitude modulate the noise signal in each of the channels. The amplitude modulated noise signals are bandpass filtered to produce output signals which are combined in predetermined amplitude proportions, amplified and coupled to an output amplifier and loudspeaker. The digital counter automatically operates control circuits that adjust the envelope of each channel as a function of the tempo of the musical selection being performed, and also controls the opening and closing of an output gate for coupling the summed signal to the loudspeaker during predetermined time periods of a duration determined by the tempo and in timed relationship with the initiation of a brush cycle. when reproduced, the gated signal produces a sound highly imitative of that produced when a wire brush is rotated around the head of a snare drum.

BRIEF DESCRIPTION OF THE DRAWINGS

Other objects, features and advantages of the invention will become apparent, and its construction and operation better understood, from the following detailed description, taken in conjunction with the accompanying drawings, in which.

DESCRIPTION OF THE PREFERRED EMBODIMENT

Figure 1:
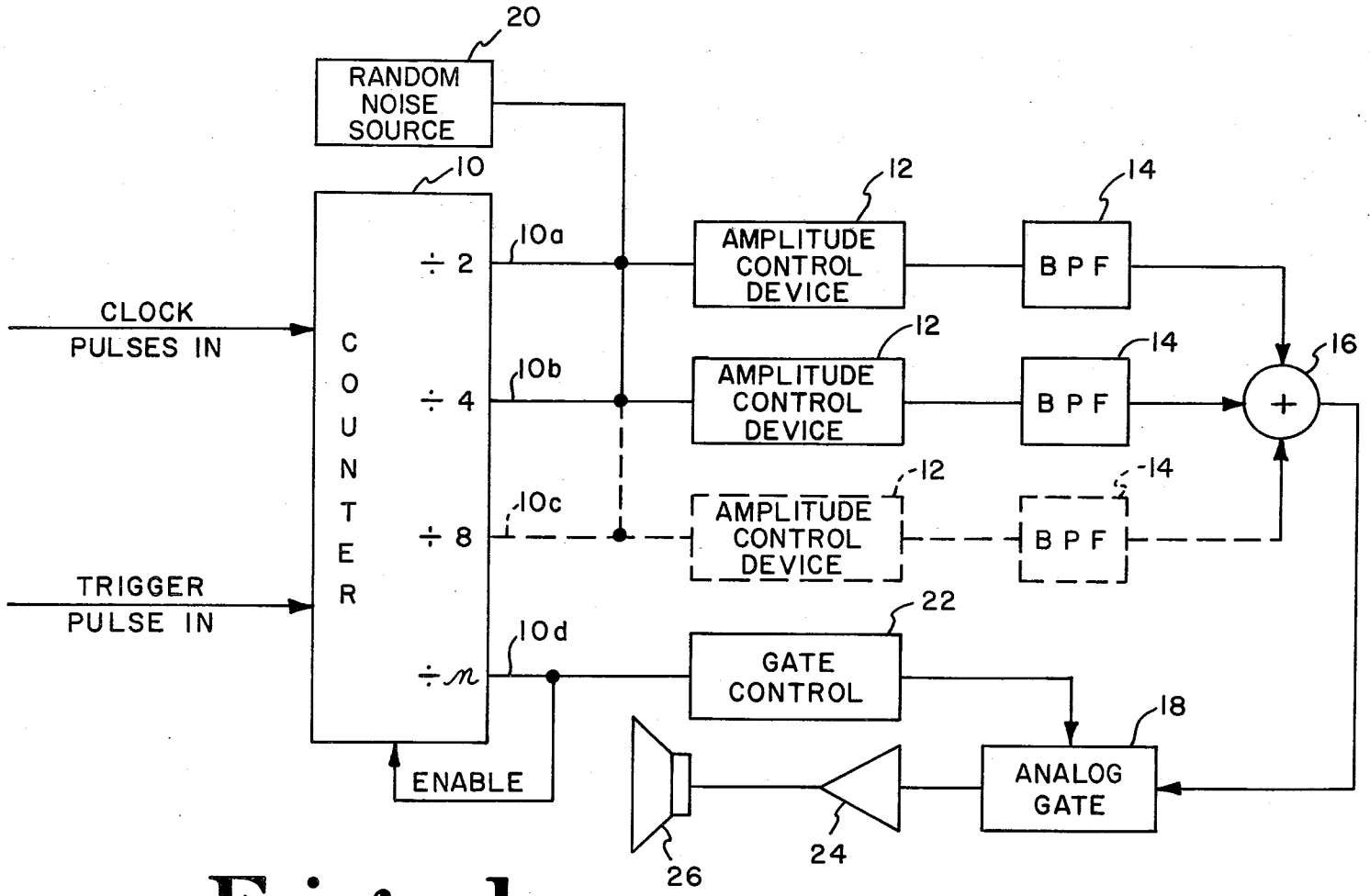
FIG. 1 is a general block diagram of a circuit embodying the invention.

Referring to FIG. 1, the instrument according to the invention, which will hereinafter be termed a "long brush" instrument, consists essentially of a digital counter 10 having a plurality of output terminals, a plurality of signal channels each including a signal amplitude adjusting device 12 and a suitable filter, such as a bandpass filter 14. A source 20 of random noise, such as a "white noise" source, is connected to and delivers to each of the signal channels an electrical signal having a very wide distribution of energy throughout the audio frequency spectrum. Each amplitude adjusting device 12 controls the amplitude or envelope of the noise signal transmitted therethrough, and in the specific embodiment to be described the envelope of the transmitted signal, which is different for each channel, is determined by the charging and discharging of a respective capacitor, all under control of counter 10. More particularly, upon being enabled by a trigger pulse contained in a train of pulses from the rhythm pattern generator of the electronic organ when a rhythm pattern utilizing the "long brush instrument" is selected, binary counter 10 counts clock pulses derived from the rhythm pattern generator of the organ, the rate of which is determined by the tempo control of the pattern generator, to produce changes in voltage level at its several output terminals at different predetermined times reckoned from the time of occurrence of the trigger pulse. In the general embodiment illustrated in FIG. 1 having n signal modulating channels and one control channel, the voltage level at output terminal 10*a* changes state for every negative-going transition of an input clock pulse; that is, terminal 10*a* undergoes one cycle of change for every two input clock cycles. Similarly, at the divide-by-four terminal 10*b*, the voltage level changes state for every two negative-going transitions of input clock pulses; thus, there is one cycle of change for every four input clock cycles. In similar fashion, the divide-by-n output terminal undergoes one cycle of change for every n input clock pulses.

The capacitor in each of the amplitude adjusting devices 12 is connected to be quiescently charged to a predetermined potential, to be discharged through a series resistor when its associated counter output terminal is in the active state, and to again be charged through a charging resistor when the associated counter output terminal returns to its quiescent level. Thus, when a count is initiated by an input trigger pulse, and assuming that n equals sixteen, the capacitor associated with the divide-by-four output terminal of the counter discharges for the period of two clock pulses, recharges for two clock pulses, and then repeats the cycle. Similarly, the capacitor associated with the divide-by-eight output terminal discharges for four clock pulses and then recharges for the next four clock pulses. The result is that the random noise signal is differently amplitude modulated in the different channels in that the envelope of each has a different characteristic, but cyclically related to the characteristics of the other channels, during the period of each counting cycle. That is, in this example the "long brush" cycle is eight clock pulses long, during which the capacitor associated with the divide-by-four output of counter discharges and charges twice and the capacitor associated with the divide-by-eight output discharges once and charges once. The result is that the loudness variation in the signal from the channel associated with the divide-by-eight output is slower than the loudness variation in the signal from the channel associated with the divide-by-four output. The counter returns to its initial state after n/2 clock cycles.

The amplitude modulated noise signal in each channel is bandpass filtered and then all are combined in a summing device, schematically shown at 16, the output from which is applied to a gating circuit 18, the opening and closing of which is controlled by another envelope control device 22 connected to output terminal 10*d* of the counter. During the period commencing with the occurrence of a trigger pulse that initiates the counting cycle, which typically may occur on the down beat and the third beat of a four-beat measure, and substantially in coincidence with a pulse in the train of clock pulses, and ending with occurrence of the nth clock pulse thereafter, output terminal 10*d* is at its active level and causes envelope control device 22 to deliver a gating signal of that duration to gating circuit 18 to allow the latter to couple the combined signal at the output of summing device 16 to an audio amplifier 24 and a loudspeaker 26. A change in the state of terminal 10*d* upon occurrence of the nth pulse terminates the counting cycle, and turns gating circuit 18 off. Thus, the combined signal is coupled to the loudspeaker 26 during the period of n clock pulses, and when reproduced simulates the cyclic variations in sound produced when a wire brush is rotated around the head of a snare drum. Such variations can be said to occur cyclically, one such cycle occurring during one complete revolution (360°) of the brush around the drum and another cycle being completed in only half of a rotation (180°).

Figure 2:
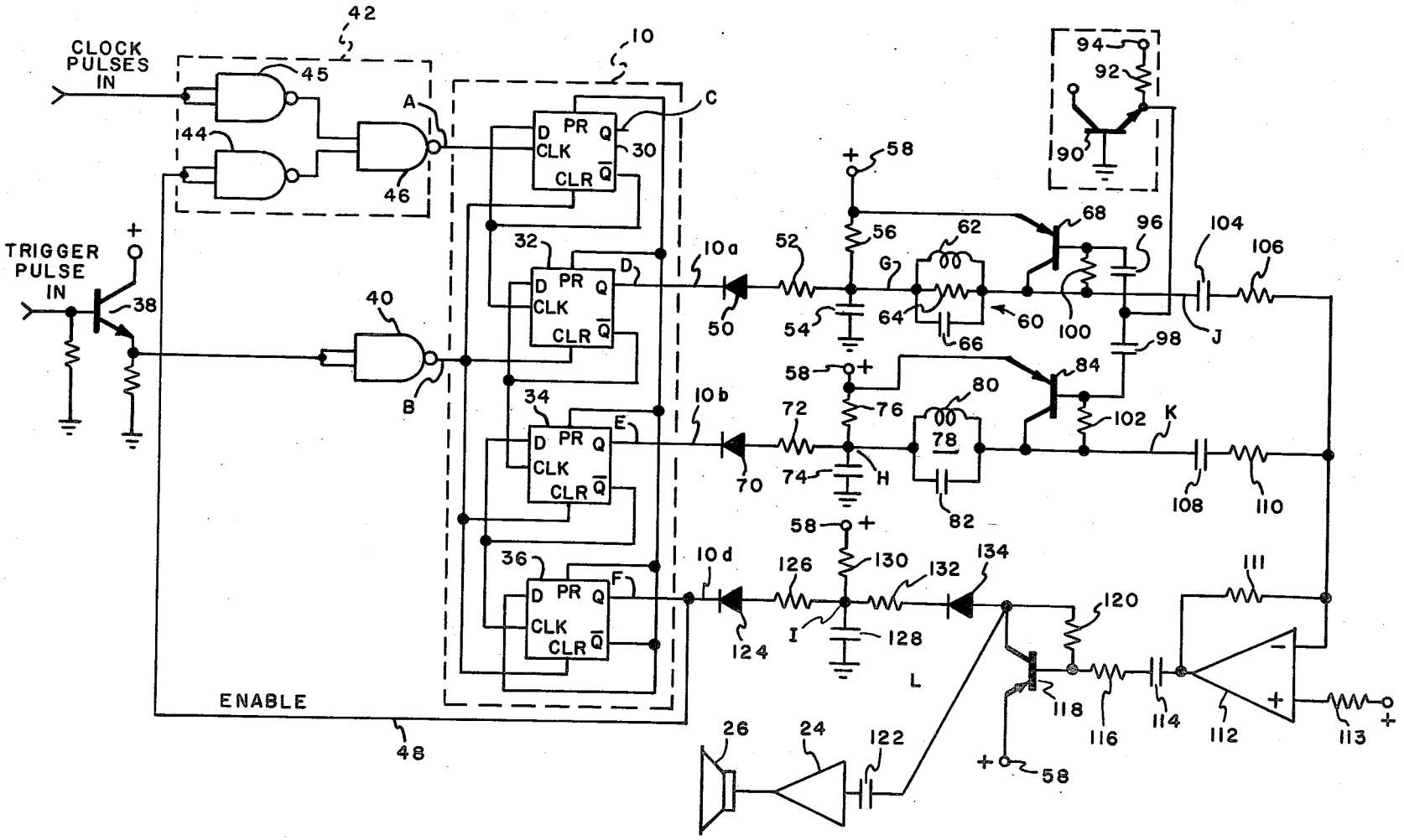
FIG. 2 is a schematic circuit diagram of a preferred embodiment of the invention.
Figure 3:
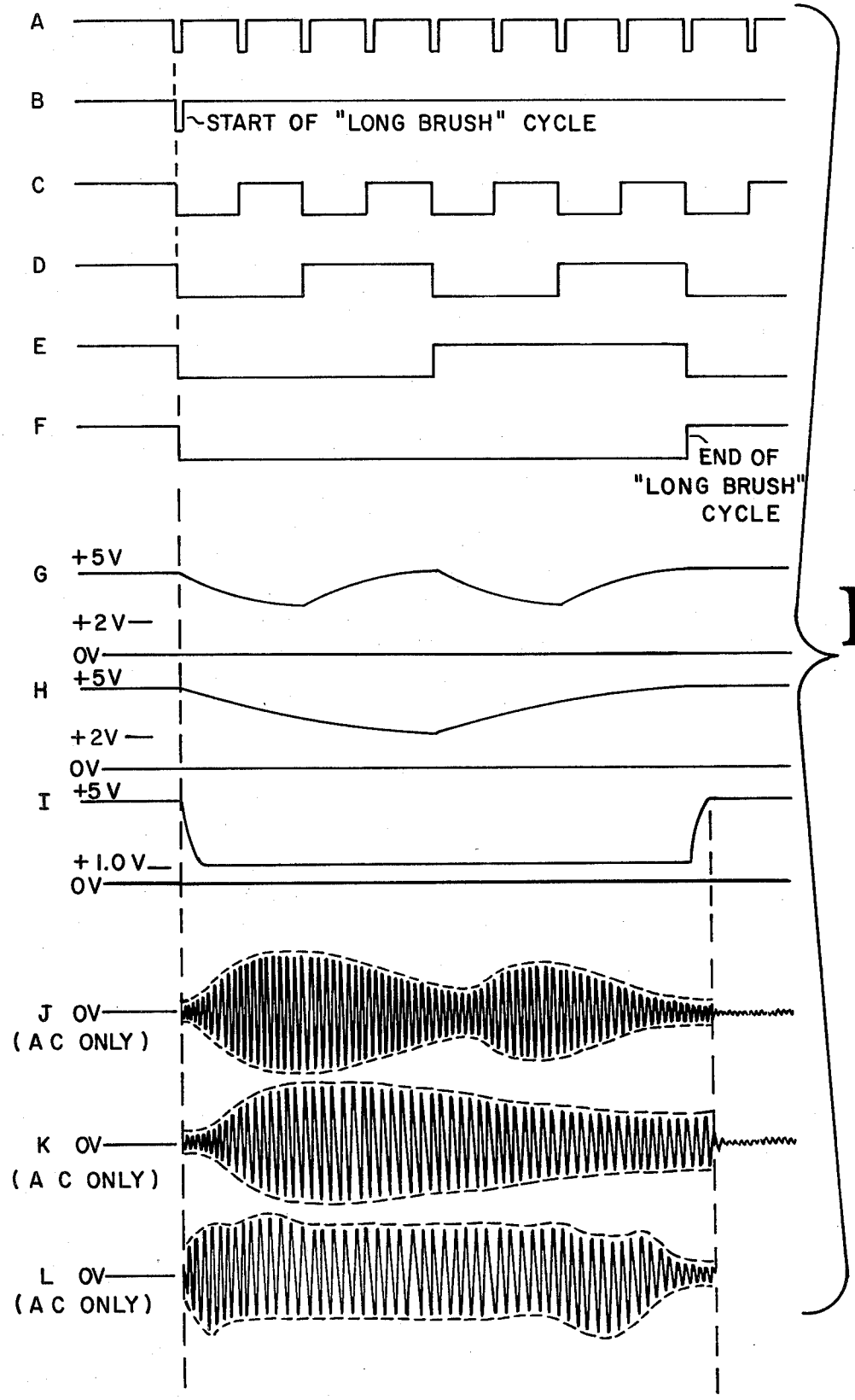
FIG. 3 is a timing diagram useful to the understanding of the operation of the circuit of FIG. 2.

FIG. 2 is a circuit diagram of a preferred implementation of the system shown in block diagram form in FIG. 1, the operation of which will be clear from reference to the timing diagram of FIG. 3. The illustrated circuit was designed for use with a rhythm pattern generator that delivers thirty-two clock pulses per measure; however, to achieve the desired simulation of the cyclical variations in sound produced when a wire brush is rotated around a snare drum head, it was found necessary to employ clock rates of two, four and eight clock pulses per measure. To accomplish this objective, the clock pulses from the rhythm pattern generator were divided down to sixteen cycles per measure before application to the circuit of FIG. 2; this pulse train is illustrated in waveform A in FIG. 3. With these system design constraints in mind, counter 10 comprises four D-type flip-flops 30, 32, 34 and 36, each having "D," "clock," "clear" and "preset" inputs and Q and $\overline{Q}$ outputs wired as a divide-by-sixteen counter. A "long brush" cycle is initiated by a trigger pulse from the rhythm pattern generator of the organ coupled through a trigger input circuit including an NPN transistor 38 connected as an emitter follower. The trigger pulse, appearing as a logic "1" at the emitter of transistor 38, is inverted by a NAND gate inverter 40 and appears as a logic "0" at the "clear" inputs of each of the flip-flops 30–36, thereby clearing the Q outputs of all of them to logic "0." Clock pulses derived from the rhythm pattern generator of the organ, having a rate determined by the tempo control of the pattern generator, are applied to the "clock" input of flip-flop 30 through an OR gate 42 which, in the interest of minimizing the number of integrated circuits, consists of three NAND gates 44, 45 and 46 which, along with inverter 40 are fabricated from four NAND gates located on one 7400 TTL integrated circuit chip. It will, of course, be appreciated that this implementation is merely an economic expedient and may take other forms. When the Q outputs are cleared, a logic "1" generated at the Q output of flip-flop 36 enables OR gate 42, allowing input clock pulses to be applied to flip-flop 30 to start a counting cycle. The times of occurrence of trigger pulses is determined by the selected rhythm pattern, typically occurring on the downbeat and the third beat of a four-beat measure, and are so timed with the clock pulses that any trigger pulse is always essentially coincident with a pulse in the clock pulse train, so that the clock pulse occurring at the time of the initiating trigger pulse may be regarded as the "first" clock pulse in the counting cycle. The count proceeds from $0000_2$ to $0111_2$, during which the Q output of flip-flop 32 is at logic "0" for the first two clock pulses, at logic level "1" for the next successive two clock pulses, and at logic level "0" for the next two clock pulses; the Q output of flip-flop 34 is at logic "0" for the first four clock pulses and at logic "1" for the next four clock pulses; and the Q output of 36 is at logic level "0" for eight clock pulses and then returns to logic level "1." At the onset of the ninth clock pulse, the $\overline{Q}$ output of flip-flop 36 is at logic level "1" for an instant, thereby to preset all of the flip-flops so that their Q outputs read 1111. The logic "1" appearing at the Q output of flip-flop 36 applied over line 48 to NAND gate 44 inhibits the clock pulses at OR gate 42 until another trigger pulse arrives. The circuit is arranged such that application of a trigger pulse, at any time in the counting cycle, will initiate a new counting cycle. It will be appreciated that flip-flop 30, which provides a division-by-two, is required to obtain at the "Q" outputs of flip-flops 32, 34 and 36 clock rates of two, four and eight cycles per measure at the earlier-described input clock rate of sixteen cycles per measure.

The described count sequence enables the direct interface between flip-flops 32 and 34 and respective signal channels, and between flip-flop 36 and a gating control channel. More particularly, the Q output terminal 10*a* of flip-flop 32 is connected through a diode 50 and a series resistor 52 to one terminal of a capacitor 54, the other terminal of which is connected to ground. The junction between resistor 52 and capacitor 54 is connected through a resistor 56 to a source of positive potential represented by terminal 58, typically having a value of +5 volts. The junction between resistor 52 and capacitor 54 is also connected to one terminal of a tuned tank circuit 60 consisting of an inductor 62, a resistor 64 and a capacitor 66 all connected in parallel, the other terminal of which is connected to the collector electrode of a PNP transistor 68, the emitter electrode of which is connected to potential source 58.

Similarly, the Q output terminal 10*b* of flip-flop 34 is connected to a second signal channel through a diode 70 and a series resistor 72 to one terminal of a capacitor 74, the other terminal of which is connected to ground. The junction of resistor 72 and capacitor 74 is connected through a resistor 76 to the source 58 of positive potential. The junction of resistor 72 and capacitor 74 is connected to one terminal of a second tuned tank circuit 78 consisting of an inductor 80 and a capacitor 82 connected in parallel, the other terminal of which is connected to the collector electrode of a second PNP transistor 84, the emitter electrode of which is connected to potential source 58.

A source 20 of random noise is connected to inject a random noise signal into both of the described signal channels. The source preferably comprises a back-biased PNP junction transistor 90 having its base electrode connected to ground, its collector electrode unconnected, and its emitter electrode connected through a resistor 92 to a source of positive potential, represented by terminal 74, typically having a value of +17 volts. When the base-emitter junction of transistor 90 is operated with reverse bias sufficient to cause zener or avalanche breakdown, the current flow through the junction is random due to the avalanche current multiplication effect causing a "white noise" signal, that is, an electrical signal having constant average power per hertz of bandwidth, to appear at the emitter electrode. This noise signal is injected into both of the signal channels through capacitors 96 and 98 respectively connected to the base electrodes of transistors 68 and 84. The base electrode of each of these transistors is also connected to its associated collector electrode through resistors 100 and 102, respectively, for supplying bias to the base electrodes of these transistors.

The tank circuit 60 in the collector circuit of transistor 68 is connected through series-connected capacitor 104 and resistor 106 and to a corresponding output circuit from the tank circuit 78, consisting of series-connected capacitor 108 and resistor 110. Each of the tank circuits and its associated transistor act as a low Q bandpass filter, the LC components of tank circuit 60 having values to give a resonant frequency of about 6.7 KHz, and the reactive components of tank circuit 78 having values to give a resonant frequency of about 17 KHz. As will be seen, the two channels function to control the amplitude of the bandpass filtered noise signal.

The output signal from the two channels are summed in proportions determined by the relative values of resistors 106 and 110 and amplified by a "Norton" amplifier 112, such as one section of an LM 3900 integrated circuit, connected to function as a summer. In particular, the junction of resistors 106 and 110 is connected to the inverting input of amplifier 112, the noninverting input is connected through a resistor 113 to a source of positive potential, and a feedback resistor 111 having a value one-half that of resistor 113 is connected between the output terminal of the amplifier and the inverting input. The output terminal of the amplifier is connected through a capacitor 114 and series-connected resistor 116 to the base electrode of a transistor 118, the emitter electrode of which is connected to potential source 58 and the collector of which is connected to the base electrode through a resistor 120. The output signal from the "long brush" instrument is taken from the collector electrode of transistor 118 and coupled through a capacitor 122 to a suitable audio amplifier 24 and loudspeaker 26.

Transistor 118 is gated on for the duration of an eight count cycle by an enabling circuit connected to the Q output terminal 10*d* of flip-flop 36; this enabling circuit consists of a diode 124 and a resistor connected in series to one terminal of a capacitor 128, the other terminal of which is connected to ground. The junction of resistor 126 and capacitor 128 is connected through a resistor 130 to potential source 58 and also through a resistor 132 and a diode 134 to the collector electrode of transistor 118. By virtue of capacitor 128 being initially charged to approximately +5 volts, upon initiation of a counting cycle, the Q output of flip-flop 36 goes to "0" logic level for the duration of eight clock pulses, causing capacitor 128 initially to discharge with a time constant determined mainly by the values of capacitor 128 and resistor 126 to a level of approximately +1 volt, and to remain at this level until the Q output is returned to logic level "1" by the onset of the ninth clock pulse, whereupon capacitor 128 quickly recharges with a time constant mainly determined by the values of resistors 130 and 132 and capacitor 128 to produce a gating signal having the waveform shown at I in FIG. 3. This gating signal, applied to the collector electrode of transistor 118, gates the transistor on for the duration of an eight count cycle, causing the signal delivered by amplifier 112 appearing at the collector electrode of transistor 118 to be coupled to the loudspeaker for the period of eight clock pulses. The described enabling circuit softens the turn on and turnoff of transistor 118 and minimizes transients that would otherwise be generated if the transistor were abruptly turned on and off.

Considering the operation of the two signal channels in greater detail, in their quiescent state amplitude controlling capacitors 54 and 74 are charged to near +5 volts and discharge through their respective series resistors 52 and 72 into the Q outputs of their associated flip-flops when these outputs are at "0" logic level. When these Q outputs return to logic level "1," the presence of diodes 50 and 70 cause capacitors 54 and 74 to charge through their respective charging resistors 56 and 76 and PNP transistor 68 and 84, which are essentially in parallel with respective ones of the charging resistors. Each of these two capacitors, together with their associated charging and discharging circuits, function to control the amplitude of the filtered noise signal delivered to the output of the circuit. Following initiation of a counting cycle by an input trigger pulse (waveform D in FIG. 3), capacitor 74 connected to the Q output of divide-by-eight flip-flop 34 (waveform E) discharges for the period of four clock pulses, the value of the capacitor and associated resistors being such as to discharge to a voltage of approximately +2 volts, and then when the Q output returns to logic level "1" recharges during the period of the next four successive clock pulses back to a potential slightly less than +5 volts. Similarly, capacitor 54 connected to the Q output of the divide-by-four flip-flop 32 initially charged to near +5 volts discharges for the period of two clock pulses to a potential of about +3.5±0.5 volts, recharges for the next two successive pulses to approximately +4.5 volts, and then repeats the cycle. The resulting envelopes appearing at the ungrounded terminal of capacitors 54 and 74 are illustrated in waveforms G and H, respectively, of FIG. 3.

When control capacitor 54 discharges, its associated transistor 68 conducts and the noise signal applied to its base electrode is amplified and appears at the collector electrode as bandpass filtered noise due to the presence of the tuned tank circuit 60 in the collector circuit. Similarly, when capacitor 74 discharges, its associated transistor 84 conducts and the noise signal applied to its base electrode is amplified and appears at the collector as bandpass filtered noise due to tuned tank circuit 78 in the collector circuit. Thus, the resulting signals at the collectors of transistors 68 and 84 are amplitude modulated bandpass filtered noise signals, generally of the form illustrated in waveform J and K, respectively, in FIG. 3. These two signals, which have different center frequencies as previously indicated, are summed in proportions determined by the relative values of resistors 106 and 110, which in a system that has operated satisfactorily have resistance values of 68K ohms and 220K ohms, respectively, and amplified by "Norton" amplifier 112. The resultant signal coupled to the loudspeaker circuit under control of the enabling gate (waveform I) is of the form illustrated in waveform L of FIG. 3. It will be observed that its envelope is unsymmetrical about the zero-axis, with the amplitude of the signal decreasing rather sharply during approximately the final one-third of the "long brush" cycle. This composite signal when reproduced by the loudspeaker produces a sound highly simulative of that produced when a wire brush is rotated around the head of a snare drum.

The described use of a counter responsive to clock pulses from the rhythm pattern generator, the rate of which pulses is adjustable by the tempo control of the rhythm generator, for controlling the amplitude controlling devices and the gating circuit, causes the rate of the simulated rotation of the wire brush on the drum head to be automatically controlled as a function of the tempo. That is, the faster the tempo selected by the instrumentalist, the faster the rhythmic variation in the timbre of the sound produced by reproduction of the signal, and the faster the simulated rotation of the brush around the drum head.

Although the embodiment of FIG. 2 has but two signal channels which differently amplitude modulate a filtered noise signal, and a third circuit controlled by the counter for enabling the output gate, it is within the contemplation of the invention to utilize additional signal channels for modulating and filtering the noise signal; such a modification would, of course, require the use of a counter capable of making more divisions so as to be able to separately control the additional signal channels. Also, although the noise source 20 in the FIG. 2 implementation has been described as generation "white noise," it is to be understood that an acceptable simulation of the sound of a wire brush rotated around the head of a snare drum can be achieved with a random noise signal that may not fully satisfy the accepted definition of "white noise." Further, although the described bandpass filters have a fixed center frequency, it is within the contemplation of the invention to provide filters having a variable center frequency controllable by the counter or by some other means.

I claim:

1. In an electronic organ including a loudspeaker, and a rhythm pattern generator including a source of clock pulses having a selectable repetition rate and a source of trigger pulses in timed relationship with said clock pulses, apparatus for generating an electrical signal which when reproduced by said loudspeaker simulates the sound produced when a wire brush is rotated around the head of a snare drum, said apparatus comprising:

at least two signal channels each including a signal amplitude controlling device and a filter, a source of random noise connected to each of said signal channels, means including a digital counter having data and trigger input terminals respectively connected to receive clock and trigger pulses from said rhythm pattern generator and a plurality of output terminals two of which are each connected to a respective one of said at least two signal channels, said digital counter being operative in response to said clock pulses to differently control the amplitude controlling device in said at least two signal channels for differently amplitude modulating said random noise signal in each of said noise channels, means for combining the amplitude modulated filtered noise signals from said at least two signal channels to produce a composite output signal, and means for applying said composite output signal to said loudspeaker for a period corresponding to the period of a predetermined number of said clock pulses.

2. Apparatus in accordance with claim 1, wherein each of said filters is a bandpass filter.

3. Apparatus in accordance with claim 2, wherein the bandpass filters in said at least two signal channels have different center frequencies whereby to pass different portions of the frequency spectrum of said random noise signal.

4. Apparatus in accordance with claim 1, wherein said amplitude modulated filtered noise signals from said at least two signal channels are combined in different amplitude proportions.

5. Apparatus in accordance with claim 1, further including means connected to an output terminal of said digital counter other than said two output terminals for producing a gating signal having a duration substantially equal to said predetermined number of clock pulses, and wherein said means for applying said composite signal to said loudspeaker is a gating circuit connected to receive and controllable by said gating signal.

6. Apparatus in accordance with claim 1, wherein said amplitude controlling devices each include a capacitor connected to be quiescently charged to a predetermined potential and to be discharged with a predetermined time constant when the potential at the output terminal of the counter associated therewith is charged from a first logic level to a second logic level in response to a preselected number of clock pulses applied to said counter and to again be charged with a predetermined time constant when the potential at the output terminal of the counter associated therewith is changed from said second level to said first level in response to said preselected number of successively occurring clock pulses.

7. Apparatus in accordance with claim 6, wherein the potential at the counter output terminal associated with one of said at least two signal channels changes from said first level to said second level twice as often as the potential changes at the counter output terminal associated with the other of said at least two signal channels.

8. Apparatus according to claim 7, wherein said digital counter has a counting cycle equal to said predetermined number of clock pulses and includes means for initiating a counting cycle in response to application of a trigger pulse from said source of trigger pulses.

9. In an electronic organ including a loudspeaker, and a rhythm pattern generator including a source of clock pulses of controllable repetition rate and a source of trigger pulses in timed relationship with said clock pulses, apparatus for generating an electrical signal which when reproduced by said loudspeaker simulates the sound produced when a wire brush is rotated around the head of a snare drum, said apparatus comprising:

at least first and second signal channels each including a signal amplitude controlling device and a bandpass filter, a source of substantially "white noise" connected to each of said signal channels, means including a digital counter having a predetermined counting cycle connected to receive clock pulses from said rhythm pattern generator and operative in response thereto divide the frequency of said clock pulses and to produce at one output terminal changes in potential level between a first level and a second level at twice the rate that corresponding changes in potential level occur at a second output terminal, means connecting the amplitude controlling device in said at least first and second signal channels to the first and second output terminal, respectively, of said counter, each of said amplitude controlling devices including a capacitor connected to be quiescently charged to a predetermined potential, to be discharged with a first predetermined timed constant when its associated counter output terminal is changed from said first level to said second level and to be charged with a second predetermined time constant when its associated counter output terminal is changed from said second to said first level, whereby said at least first and second signal channels differently amplitude modulate said "white noise" signal, means for combining in different amplitude proportions the amplitude modulated bandpass filtered noise signals from said at least first and second signal channels to produce a composite signal, gating circuit means operative in response to a gating signal to couple said composite signal to said loudspeaker, and circuit means including an RC time constant circuit controllable by said counter for producing and applying to said gating circuit a gating signal having a duration equal to the period of the number of pulses in said counting cycle.

10. For use with a rhythm pattern generator including a source of clock pulses of selectable rate, an electric circuit comprising:

at least two signal channels each including a parallel tuned circuit, a noise generator connected to each of said signal channels, signal amplitude controlling means in each of said channels including a capacitor connected to its respective parallel tuned circuit, digital counter means connected to receive clock pulses from said rhythm pattern generator and operative in response thereto to cause the capacitors in the amplitude controlling devices in said signal channels to be alternately discharged and charged at different rates, whereby each channel cyclically amplitude modulates said noise signal at different cyclical rates, and means for combining in preselected amplitude proportions the amplitude modulated filtered noise signals from said at least two signal channels to produce a composite output signal having an unsymmetrical decaying wave envelope which when acoustically reproduced simulates the sound produced when a wire brush is rotated around the head of a snare drum.

* * * * *